US011458603B2

(12) United States Patent
Boutarath

(10) Patent No.: US 11,458,603 B2
(45) Date of Patent: Oct. 4, 2022

(54) TOOL FOR INSTALLING AND REMOVING A HIGHLY-TORQUED FASTENER

(71) Applicant: Somkhith Boutarath, Youngsville, LA (US)

(72) Inventor: Somkhith Boutarath, Youngsville, LA (US)

( * ) Notice: Subject to any disclaimer, the term of this patent is extended or adjusted under 35 U.S.C. 154(b) by 264 days.

(21) Appl. No.: 16/790,600

(22) Filed: Feb. 13, 2020

(65) Prior Publication Data

US 2020/0254592 A1 Aug. 13, 2020

Related U.S. Application Data

(60) Provisional application No. 62/805,272, filed on Feb. 13, 2019.

(51) Int. Cl.
*B25B 17/00* (2006.01)
*B25B 17/02* (2006.01)
*B25B 23/00* (2006.01)

(52) U.S. Cl.
CPC ..... *B25B 17/02* (2013.01); *B25B 23/0007* (2013.01)

(58) Field of Classification Search
CPC ..... B25B 17/02; B25B 23/0007
USPC ..... 81/57, 57.3, 57.31, 177.8
See application file for complete search history.

(56) References Cited

U.S. PATENT DOCUMENTS

| | | | | |
|---|---|---|---|---|
| 4,322,989 | A | 4/1982 | Garolis | |
| 5,630,343 | A | 5/1997 | Begin | |
| 6,536,310 | B2 | 3/2003 | Goldfein | |
| 6,543,314 | B1 * | 4/2003 | Hoyt | B25B 17/00 81/57.32 |
| 11,090,783 | B2 * | 8/2021 | Angello | F16H 57/02 |
| 2003/0172780 | A1 | 9/2003 | Newell | |
| 2008/0135271 | A1 * | 6/2008 | Murphy | B25B 13/481 173/216 |
| 2016/0229037 | A1 * | 8/2016 | Quigley | B25B 21/005 |
| 2018/0216672 | A1 * | 8/2018 | Putzer | B60K 17/16 |

FOREIGN PATENT DOCUMENTS

| | | | | |
|---|---|---|---|---|
| CN | 202726806 | * | 2/2013 | B25B 23/00 |
| CN | 202726806 U | | 2/2013 | |

* cited by examiner

*Primary Examiner* — Joseph J Hail
*Assistant Examiner* — Shantese L McDonald

(57) ABSTRACT

A tool for installing and removing a highly-torqued fastener that allows an individual to easily and efficiently remove or install a bolt from or onto a crankshaft pulley or similar assembly. The tool includes a prismatic housing, a worm gear assembly, a torque input, and a torque output. The prismatic housing is a rigid structure that is used to conceal and protect the worm gear assembly. The torque input allows an individual to manually provide the torque force through the use of a ratchet tool, motor drive, or other similar tool. The torque output is able to receive a bolt socket in order for the tool to provide the torque force to a bolt of a crankshaft pulley. The worm gear assembly is used to transfer the torque force from the torque input to the torque output. Thus, the tool can easily remove or install a bolt.

18 Claims, 6 Drawing Sheets

TOOL FOR INSTALLING AND REMOVING A HIGHLY-TORQUED FASTENER

The current application claims a priority to the U.S. Provisional Patent application Ser. No. 62/805,272 filed on Feb. 13, 2019.

FIELD OF THE INVENTION

The present invention relates generally to automobile tools. More specifically, the present invention is a tool for installing and removing a highly-torqued fastener that allows an individual to easily and efficiently remove or install a bolt from or onto a crankshaft pulley or similar assemblies.

BACKGROUND OF THE INVENTION

A crankshaft is a critical part of an automobile that is not easily removable for maintenance. The bolts of a crankshaft pulley arrangement are difficult to remove due to the location, the significant amount of torque imparted on the bolt, and the small amount of space that is often provided in front of the crankshaft pulley. An individual can quickly become tired after being forced to use a considerable amount of strength to twist and remove the bolt. Further and at times, the front of an automobile may need to be dissembled if the use of an impact wrench is required. This unfortunately adds more time and frustration during the removal process. Moreover, it is also difficult for an individual to install bolts onto a crankshaft pulley. There is a need for a tool that allows an individual to easily remove or install bolts from or onto a crankshaft pulley or similar assembly.

It is therefore an objective of the present invention provide a tool for installing and removing a highly-torqued fastener that allows an individual to easily and efficiently remove or install a bolt from or onto a crankshaft pulley or similar assembly. In more detail, the present invention allows an individual to remove or install bolts from or onto various types of crankshaft pulleys while the engine is in a car and when there is not enough room for the use of an impact gun. Thus, the present invention eliminates the need for impact guns when removing bolts from a crankshaft pulley. Furthermore, the present invention reduces the amount of strength and effort required to remove a bolt from a crankshaft pulley.

DETAIL DESCRIPTIONS OF THE INVENTION

Figure 1:
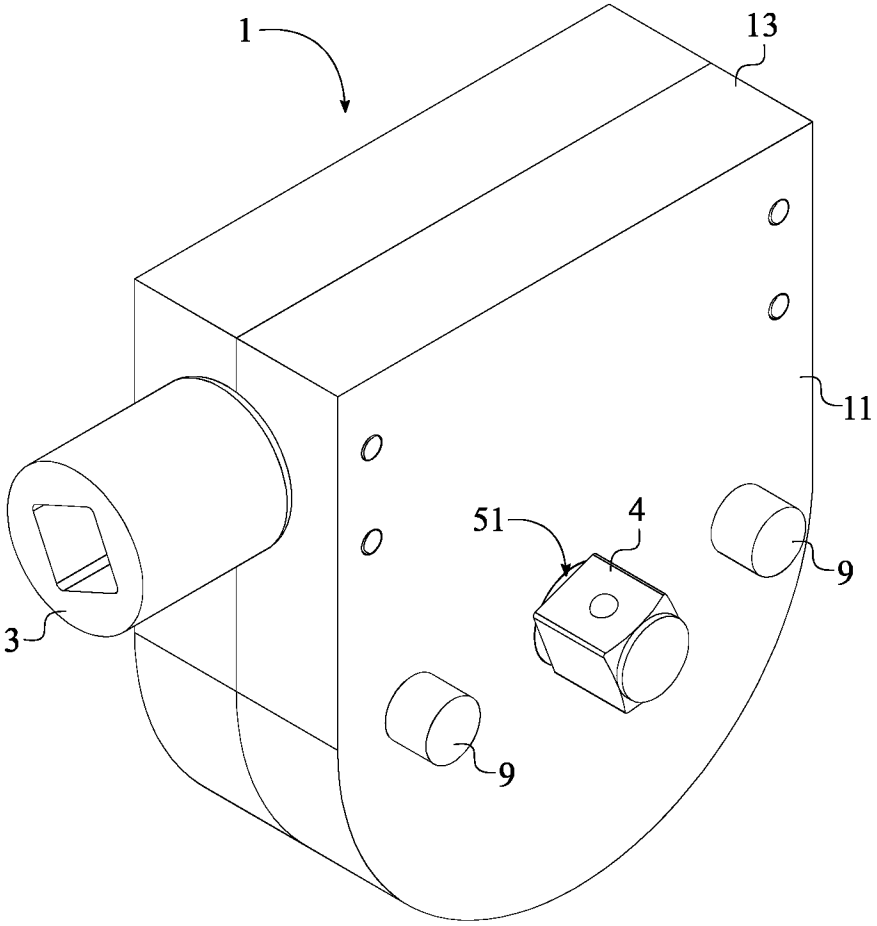
FIG. 1 is a front perspective view of the present invention without the anti-rotation adapter.

All illustrations of the drawings are for the purpose of describing selected versions of the present invention and are not intended to limit the scope of the present invention.

In reference to FIGS. 1 through 6, the present invention is a tool for installing and removing a highly-torqued fastener that allows an individual to easily and efficiently remove or install a bolt from or onto a crankshaft pulley or other similar assemblies. The present invention comprises a prismatic housing 1, a worm gear assembly 2, a torque input 3, and a torque output 4. The prismatic housing 1 is a rigid structure that is used to conceal and protect the worm gear assembly 2. The torque input 3 allows an individual to manually provide a torque force through the use of a ratchet tool, power tool or other similar tools. The torque output 4 is able to receive a bolt socket in order for the present invention to provide the torque force to a bolt of a crankshaft pulley. The worm gear assembly 2 is used to transfer the torque force from the torque input 3 to the torque output 4. Thus, the present invention can be used to easily remove or install a bolt from or onto a crankshaft pulley.

Figure 2:
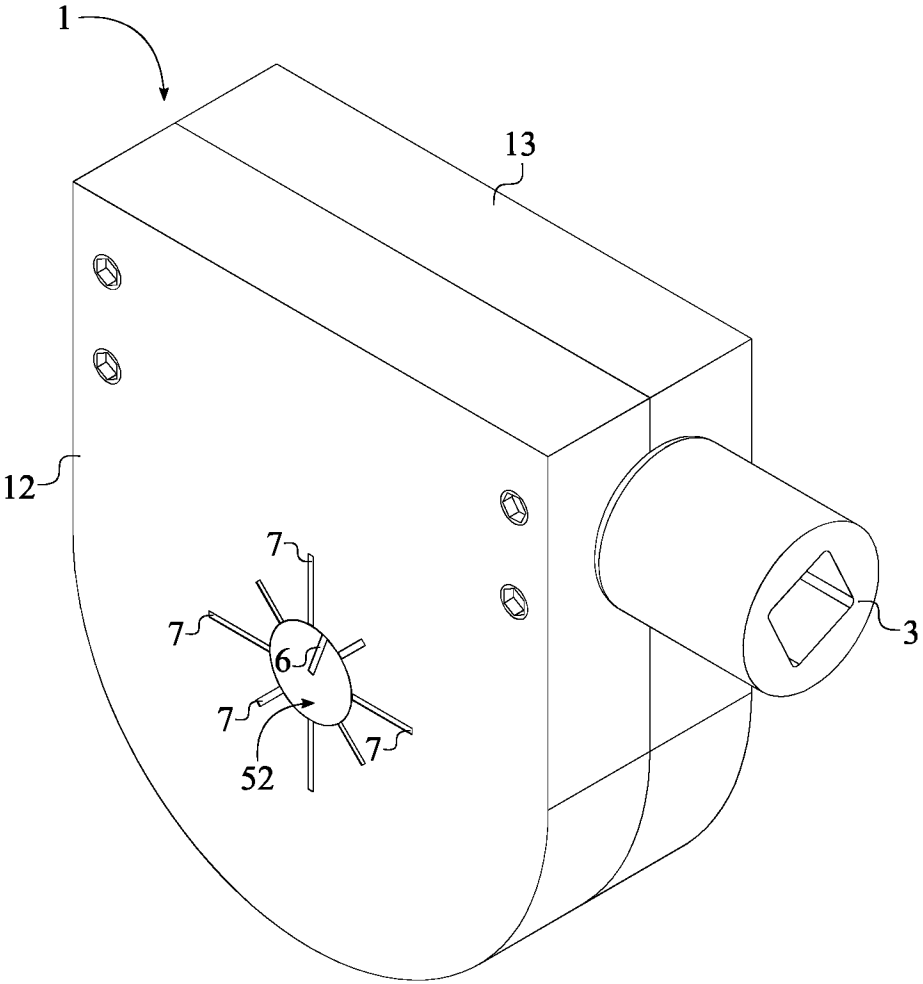
FIG. 2 is a rear perspective view of the present invention without the anti-rotation adapter.
Figure 3:
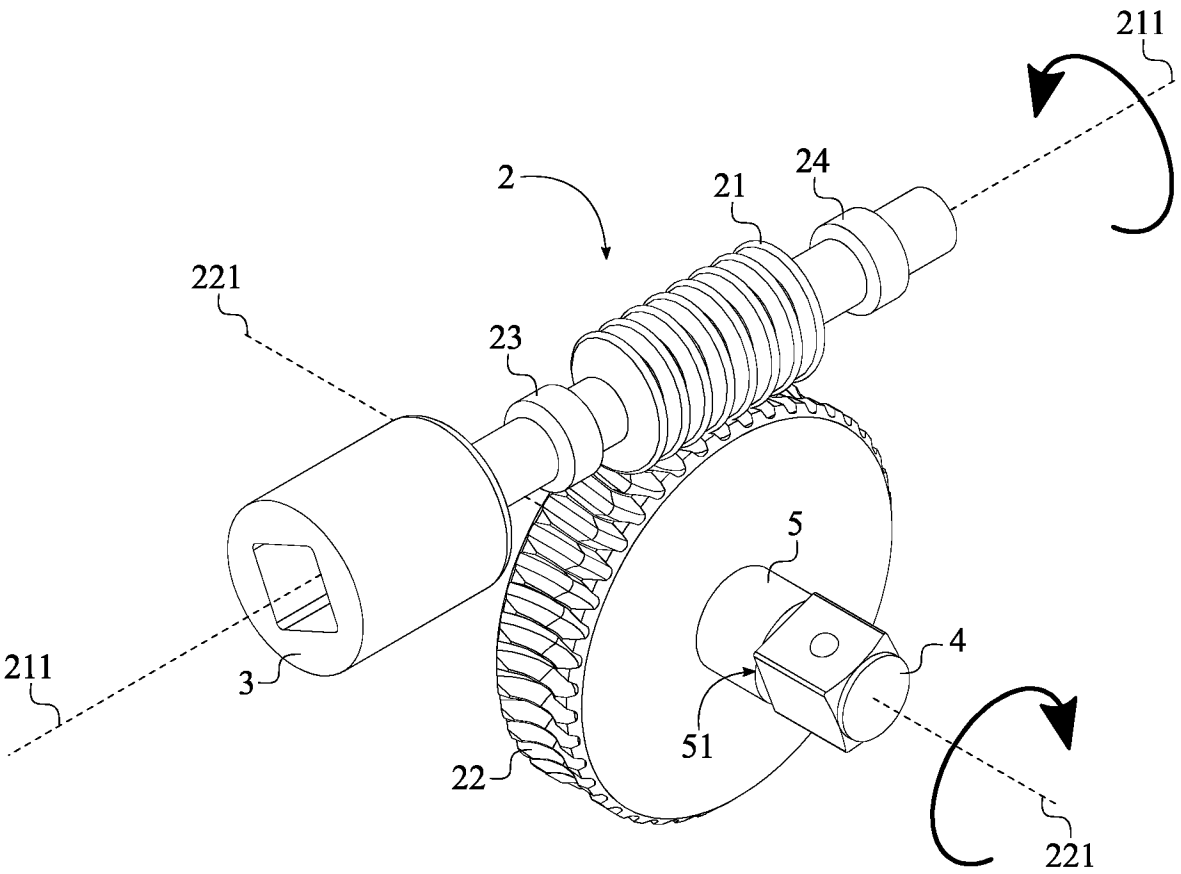
FIG. 3 is a front perspective view displaying the torque input, the torque output, and the worm gear assembly.

The general configuration of the aforementioned components allows the present invention to be used to easily and efficiently remove or install a bolt from or onto a crankshaft pulley or other similar assemblies. With reference to FIGS. 1 and 2, the prismatic housing 1 comprises a first base portion 11, a second base portion 12, and a lateral portion 13. With reference to FIG. 3, the worm gear assembly 2 comprises a worm shaft 21 and a worm wheel 22. The worm shaft 21 is rotatably mounted within the prismatic housing 1 about a shaft rotation axis 211. The shaft rotation axis 211 is the axis at which the worm shaft 21 rotates about when the present invention is in use. Further, this arrangement allows the worm shaft 21 to be rotated when the torque force is applied to the torque input 3. The worm wheel 22 is rotatably mounted within the prismatic housing 1 about a wheel rotation axis 221. The wheel rotation axis 221 is the axis at which the worm wheel 22 rotates about when the present invention is in use. Further, this arrangement allows the worm wheel 22 to be rotated in order to transfer the torque force to the torque output 4. The worm shaft 21 and the worm wheel 22 are meshed with each other in order for the worm shaft 21 and the worm wheel 22 to rotate concurrently when the torque force is applied to the torque input 3. The shaft rotation axis 211 and the wheel rotation axis 221 are positioned perpendicular to each other. This arrangement allows the torque force to be transferred from one linear direction to another linear direction. For example, when the torque force is applied along the x-direction, the worm gear assembly 2 is able to output the torque force through the z-direction. The torque input 3 is rotatably and externally mounted to the lateral portion 13. This arrangement allows an individual to easily access the torque input 3 in order to apply the torque force through the use of a ratchet tool. The torque input 3 is torsionally coupled to the worm shaft 21 in order for worm shaft 21 to be rotated when the torque force is applied to the torque input 3. The torque output 4 is rotatably and externally mounted to the first base portion 11. This arrangement allows the present invention, with a bolt socket, to engage a bolt of a crankshaft pulley or similar assembly. The torque output 4 is torsionally coupled to the worm wheel 22 in order for the torque force to be transferred from the torque input 3 to the torque output 4. Thus, the torque output 4 can apply the torque force to a bolt of a crankshaft pulley or similar assembly. In order for the torque force to be increased from the torque input 3 to the torque output 4, a gear ratio between the worm shaft 21 and the worm wheel 22 is preferably 1 to 45.

With reference to FIG. 3, the present invention may further comprise a wheel axle 5 in order for the worm wheel 22 to be torsionally coupled to the torque output 4. The wheel axle 5 comprises a first axle end 51 and a second axle end 52. The wheel axle 5 is positioned along the wheel rotation axis 221. This arrangement allows the wheel axle 5 to rotate as the worm wheel 22 is rotated. The wheel axle 5 traverses through the second base portion 12 in order to reach the torque output 4. The torque output 4 is torsionally connected to the first axle end 51. This arrangement allows the wheel axle 5 to transfer the torque force to the torque output 4. The worm wheel 22 is laterally connected to the wheel axle 5. This arrangement allows the worm wheel 22 to transfer the torque force to the wheel axle 5. The second axle end 52 is externally positioned to the prismatic housing 1 in order for an individual to view the angle at which the wheel axle 5 is oriented.

With reference to FIG. 2, the present invention may further comprise a pointer marker 6 and a plurality of degree markers 7. The pointer marker 6 and the plurality of degree markers 7 are used to indicate the how many degrees a bolt is being rotated when engaged by the present invention. The plurality of degree markers 7 is externally inscribed onto the second base portion 12 and is radially positioned around the second axle end 52. This arrangement allows an individual to easily read the plurality of degree markers 7. The pointer marker 6 is peripherally inscribed onto the second axle end 52. This arrangement allows an individual to indicate that bolt is being rotated, when engaged by the present invention, by reading the plurality of degree markers 7 and the position of the pointer marker 6.

Figure 4:
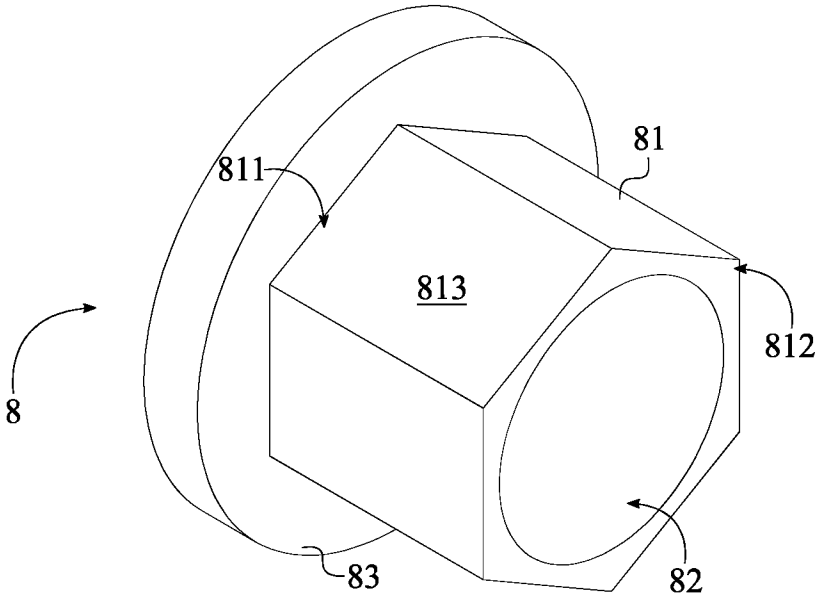
FIG. 4 is a front perspective view of the anti-rotation adapter.
Figure 5:
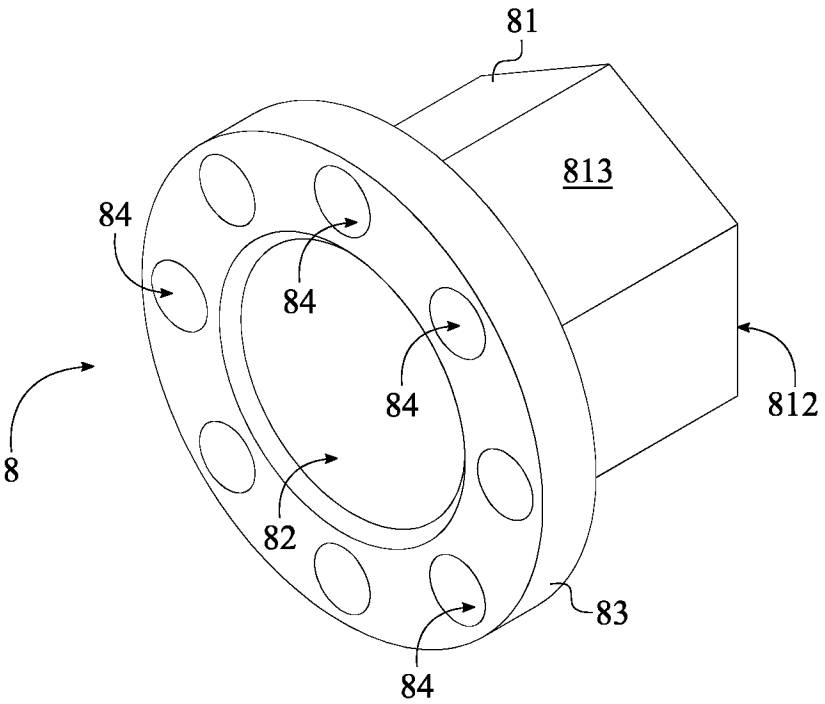
FIG. 5 is a rear perspective view of the anti-rotation adapter.
Figure 6:
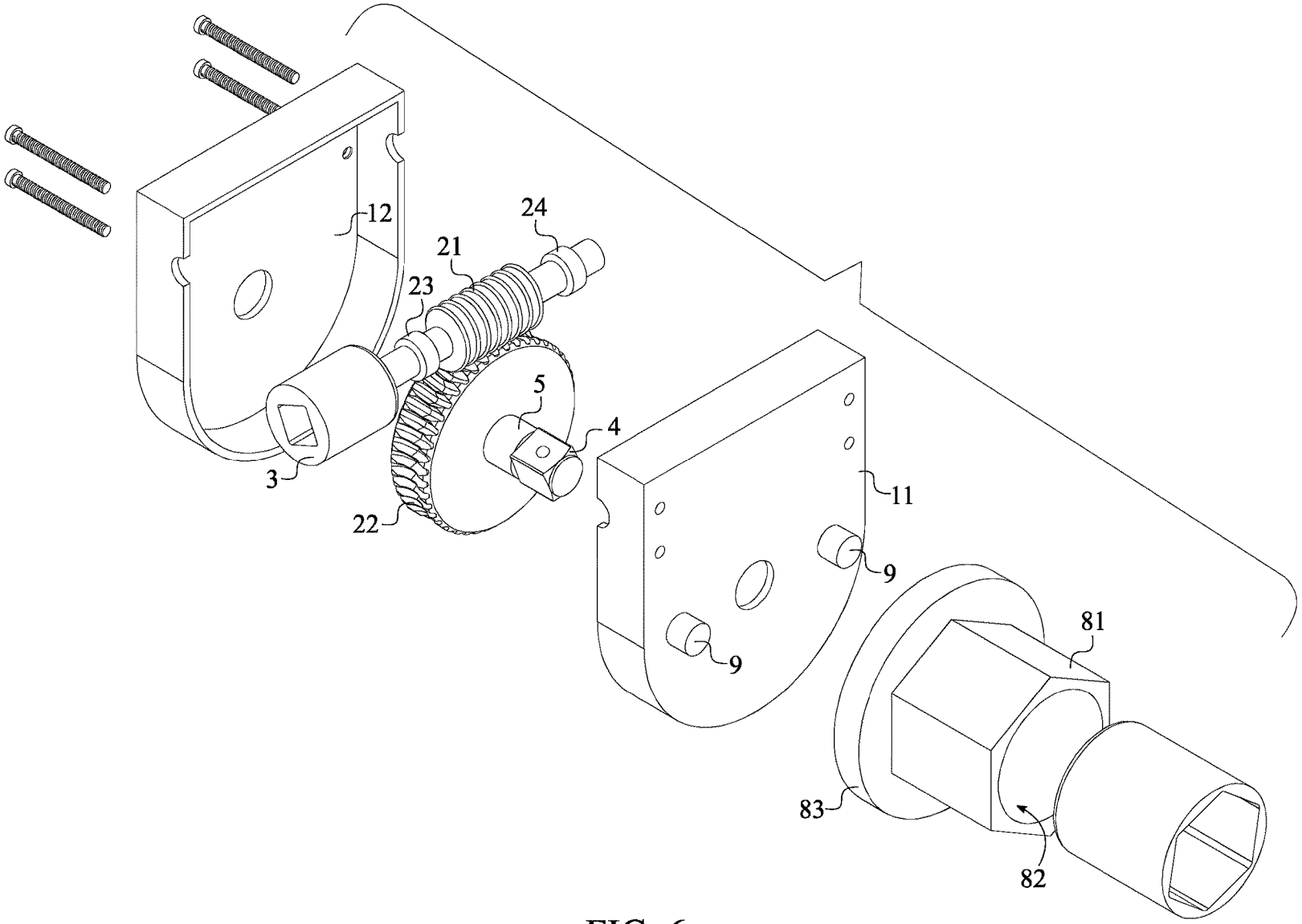
FIG. 6 is an exploded front perspective view of the present invention.

With reference to FIGS. 4 and 5, the present invention may further comprise an anti-rotation adapter 8 in order to prevent the prismatic housing 1 from rotating when the present invention is in use. The anti-rotation adapter 8 comprises an adapter body 81 and an engagement channel 82. The engagement channel 82 is designed to sleeve a bolt socket that is attached to the torque output 4. The adapter body 81 comprises a proximal body end 811, a distal body end 812, and a lateral surface 813. The engagement channel 82 traverses through the adapter body 81 from the proximal body end 811 to the distal body end 812 in order for the anti-rotation adapter 8 to engage with a socket of a crankshaft pulley or similar assembly. With reference to FIG. 6, the torque output 4 is positioned into the engagement channel 82. Thus, the torque output 4, with a bolt socket attached, can be engaged to a bolt of a crankshaft pulley while the anti-rotation adapter 8 is used to prevent rotation of the prismatic housing 1. The proximal body end 811 is torsionally and externally mounted to the first base portion 11. This arrangement allows the anti-rotation adapter 8 to be secured to the prismatic housing 1. The lateral surface 813 is positioned in between the proximal body end 811 and the distal body end 812 and is configured to brace a non-circular socket. Thus, the torque output 4, with a bolt socket attached, can apply the torque force to a bolt of crankshaft pulley or similar assembly while the prismatic housing 1 is prevented from being rotated.

With reference to FIGS. 5 and 6, the present invention may further comprise a pair of locking pins 9 in order for the anti-rotation adapter 8 to be mounted to the prismatic housing 1. The anti-rotation adapter 8 further comprises a flange 83 and a plurality of locking holes 84. The flange 83 allows the anti-rotation adapter 8 to be pressed flat against the prismatic housing 1. The plurality of locking holes 84 allow the anti-rotation adapter 8 to be mounted to the prismatic housing 1. The flange 83 is laterally connected around the adapter body 81, adjacent to the proximal body end 811. This arrangement positions the flange 83 in order for anti-rotation adapter 8 to be pressed flat against the prismatic housing 1. The plurality of locking holes 84 traverse into the flange 83 and is radially positioned around the flange 83 in order to allow the anti-rotation adapter 8 to be mounted to the prismatic housing 1 in various rotational orientations. The pair of locking pins 9 is externally connected normal to the first base portion 11 and is positioned opposite to each other about the torque output 4 in order for the prismatic housing 1 to receive the anti-rotation adapter 8. Furthermore, each of the pair of locking pins 9 engaged into a selected hole from the plurality of locking holes 84. For example, a pair diametrically opposed holes from the plurality of locking holes 84 can be engaged by the pair of locking pins 9. Thus, the anti-rotation adapter 8 is mounted to the prismatic housing 1. Preferably, the lateral surface 813 is configured into a hexagonal shape due to the common shape of a socket of a crankshaft pulley.

With reference to FIG. 3, the worm gear assembly 2 further comprises a first annular stop 23 and a second annular stop 24 in order to prevent any translational motion of the worm shaft 21. The first annular stop 23 and the second annular stop 24 are laterally connected around the worm shaft 21 and are positioned opposite to each other along the worm shaft 21. Further, the first annular stop 23 and the second annular stop 24 are internally pressed against the lateral portion 13. This arrangement allows the worm shaft 21 to rotate while also preventing the worm shaft 21 from sliding out of position within the prismatic housing 1. In further detail, this arrangement restricts linear movement of the worm shaft 21. Thus, the worm shaft 21 is able to rotate while also being prevented from sliding out of position within the prismatic housing 1.

Although the invention has been explained in relation to its preferred embodiment, it is to be understood that many other possible modifications and variations can be made without departing from the spirit and scope of the invention as hereinafter claimed.

What is claimed is:

1. A tool for installing and removing a highly-torqued fastener comprises:

a prismatic housing;

a worm gear assembly;

a torque input;

a torque output;

an anti-rotation adapter;

the prismatic housing comprises a first base portion, a second base portion, and a lateral portion;

the worm gear assembly comprises a worm shaft and a worm wheel;

the anti-rotation adapter comprises an adapter body and an engagement channel;

the adapter body comprises a proximal body end, a distal body end, and a lateral surface;

the worm shaft being rotatably mounted within the prismatic housing about a shaft rotation axis;

the worm wheel being rotatably mounted within the prismatic housing about a wheel rotation axis;

the worm shaft and the worm wheel being meshed with each other;

the shaft rotation axis and the wheel rotation axis being positioned perpendicular to each other;

the torque input being rotatably and externally mounted to the lateral portion;

the torque input being torsionally coupled to the worm shaft;

the torque output being rotatably and externally mounted to the first base portion;

the torque output being torsionally coupled to the worm wheel;

the engagement channel traversing through the adapter body from the proximal body end to the distal body end;

the torque output being positioned into the engagement channel;

the proximal body end being torsionally and externally mounted to the first base portion;

the lateral surface being positioned in between the proximal body end and the distal body end; and the lateral surface being configured to brace a non-circular socket.

2. The tool for installing and removing a highly-torqued fastener as claimed in claim 1 comprises:

a wheel axle;

the wheel axle comprises a first axle end and a second axle end;

the wheel axle being positioned along the wheel rotation axis;

the wheel axle traversing through the second base portion;

the torque output being torsionally connected to the first axle end;

the worm wheel being laterally connected to the wheel axle; and the second axle end being externally positioned to the prismatic housing.

3. The tool for installing and removing a highly-torqued fastener as claimed in claim 2 comprises:

a pointer marker;

a plurality of degree markers;

the plurality of degree markers being externally inscribed onto the second base portion;

the plurality of degree markers being radially positioned around the second axle end; and the pointer marker being peripherally inscribed onto the second axle end.

4. The tool for installing and removing a highly-torqued fastener as claimed in claim 1, wherein a gear ratio between the worm shaft and the worm wheel is 1 to 45.

5. The tool for installing and removing a highly-torqued fastener as claimed in claim 1 comprises:

a pair of locking pins;

the anti-rotation adapter further comprises a flange and a plurality of locking holes;

the flange being laterally connected around the adapter body, adjacent to the proximal body end;

the plurality of locking holes traversing into the flange;

the plurality of locking holes being radially positioned around the flange;

the pair of locking pins being externally connected normal to the first base portion;

the pair of locking pins being positioned opposite to each other about the torque output; and each of the pair of locking pins being engaged into a selected hole from the plurality of locking holes.

6. The tool for installing and removing a highly-torqued fastener as claimed in claim 1 wherein the lateral surface is configured into a hexagonal shape.

7. The tool for installing and removing a highly-torqued fastener as claimed in claim 1 comprises:

the worm gear assembly further comprises a first annular stop and a second annular stop;

the first annular stop and the second annular stop being laterally connected around the worm shaft;

the first annular stop and the second annular stop being positioned opposite to each other along the worm shaft; and the first annular stop and the second annular stop being internally pressed against the lateral portion.

8. A tool for installing and removing a highly-torqued fastener comprises:

a prismatic housing;

a worm gear assembly;

a torque input;

a torque output;

a wheel axle;

a pointer marker;

a plurality of degree markers;

the prismatic housing comprises a first base portion, a second base portion, and a lateral portion;

the worm gear assembly comprises a worm shaft and a worm wheel;

the worm shaft being rotatably mounted within the prismatic housing about a shaft rotation axis;

the worm wheel being rotatably mounted within the prismatic housing about a wheel rotation axis;

the worm shaft and the worm wheel being meshed with each other;

the shaft rotation axis and the wheel rotation axis being positioned perpendicular to each other;

the torque input being rotatably and externally mounted to the lateral portion;

the torque input being torsionally coupled to the worm shaft;

the torque output being rotatably and externally mounted to the first base portion;

the torque output being torsionally coupled to the worm wheel;

the wheel axle comprises a first axle end and a second axle end;

the wheel axle being positioned along the wheel rotation axis;

the wheel axle traversing through the second base portion;

the torque output being torsionally connected to the first axle end;

the worm wheel being laterally connected to the wheel axle;

the second axle end being externally positioned to the prismatic housing;

the plurality of degree markers being externally inscribed onto the second base portion;

the plurality of degree markers being radially positioned around the second axle end; and the pointer marker being peripherally inscribed onto the second axle end.

9. The tool for installing and removing a highly-torqued fastener as claimed in claim 8, wherein a gear ratio between the worm shaft and the worm wheel is 1 to 45.

10. The tool for installing and removing a highly-torqued fastener as claimed in claim 8 comprises:

an anti-rotation adapter;

the anti-rotation adapter comprises an adapter body and an engagement channel;

the adapter body comprises a proximal body end, a distal body end, and a lateral surface;

the engagement channel traversing through the adapter body from the proximal body end to the distal body end;

the torque output being positioned into the engagement channel;

the proximal body end being torsionally and externally mounted to the first base portion;

the lateral surface being positioned in between the proximal body end and the distal body end; and the lateral surface being configured to brace a non-circular socket.

11. The tool for installing and removing a highly-torqued fastener as claimed in claim 10 comprises:

a pair of locking pins;

the anti-rotation adapter further comprises a flange and a plurality of locking holes;

the flange being laterally connected around the adapter body, adjacent to the proximal body end;

the plurality of locking holes traversing into the flange;

the plurality of locking holes being radially positioned around the flange;

the pair of locking pins being externally connected normal to the first base portion;

the pair of locking pins being positioned opposite to each other about the torque output; and each of the pair of locking pins being engaged into a selected hole from the plurality of locking holes.

12. The tool for installing and removing a highly-torqued fastener as claimed in claim 10, wherein the lateral surface is configured into a hexagonal shape.

13. The tool for installing and removing a highly-torqued fastener as claimed in claim 8 comprises:

the worm gear assembly further comprises a first annular stop and a second annular stop;

the first annular stop and the second annular stop being laterally connected around the worm shaft;

the first annular stop and the second annular stop being positioned opposite to each other along the worm shaft; and the first annular stop and the second annular stop being internally pressed against the lateral portion.

14. A tool for installing and removing a highly-torqued fastener comprises:

a prismatic housing;

a worm gear assembly;

a torque input;

a torque output;

a wheel axle;

an anti-rotation adapter;

the prismatic housing comprises a first base portion, a second base portion, and a lateral portion;

the worm gear assembly comprises a worm shaft and a worm wheel;

the worm shaft being rotatably mounted within the prismatic housing about a shaft rotation axis;

the worm wheel being rotatably mounted within the prismatic housing about a wheel rotation axis;

the worm shaft and the worm wheel being meshed with each other;

the shaft rotation axis and the wheel rotation axis being positioned perpendicular to each other;

the torque input being rotatably and externally mounted to the lateral portion;

the torque input being torsionally coupled to the worm shaft;

the torque output being rotatably and externally mounted to the first base portion;

the torque output being torsionally coupled to the worm wheel;

the wheel axle comprises a first axle end and a second axle end;

the wheel axle being positioned along the wheel rotation axis;

the wheel axle traversing through the second base portion;

the torque output being torsionally connected to the first axle end;

the worm wheel being laterally connected to the wheel axle;

the second axle end being externally positioned to the prismatic housing;

the anti-rotation adapter comprises an adapter body and an engagement channel;

the adapter body comprises a proximal body end, a distal body end, and a lateral surface;

the engagement channel traversing through the adapter body from the proximal body end to the distal body end;

the torque output being positioned into the engagement channel;

the proximal body end being torsionally and externally mounted to the first base portion;

the lateral surface being positioned in between the proximal body end and the distal body end; and the lateral surface being configured to brace a non-circular socket.

15. The tool for installing and removing a highly-torqued fastener as claimed in claim 14 comprises:

a pointer marker;

a plurality of degree markers;

the plurality of degree markers being externally inscribed onto the second base portion;

the plurality of degree markers being radially positioned around the second axle end; and the pointer marker being peripherally inscribed onto the second axle end.

16. The tool for installing and removing a highly-torqued fastener as claimed in claim 14, wherein a gear ratio between the worm shaft and the worm wheel is 1 to 45.

17. The tool for installing and removing a highly-torqued fastener as claimed in claim 14 comprises:

a pair of locking pins;

the anti-rotation adapter further comprises a flange and a plurality of locking holes;

the flange being laterally connected around the adapter body, adjacent to the proximal body end;

the plurality of locking holes traversing into the flange;

the plurality of locking holes being radially positioned around the flange;

the pair of locking pins being externally connected normal to the first base portion;

the pair of locking pins being positioned opposite to each other about the torque output; and each of the pair of locking pins being engaged into a selected hole from the plurality of locking holes; and the lateral surface being configured into a hexagonal shape.

18. The tool for installing and removing a highly-torqued fastener as claimed in claim 14 comprises:

the worm gear assembly further comprises a first annular stop and a second annular stop;

the first annular stop and the second annular stop being laterally connected around the worm shaft;

the first annular stop and the second annular stop being positioned opposite to each other along the worm shaft; and the first annular stop and the second annular stop being internally pressed against the lateral portion.

* * * * *